US011769618B2

(12) United States Patent
Repasi et al.

(10) Patent No.: US 11,769,618 B2
(45) Date of Patent: Sep. 26, 2023

(54) ELECTRICAL INDUCTION DEVICE WITH CONTACT ARRANGEMENT FOR ELECTRICALLY CONTACTING AN ELECTRICAL CONDUCTOR

(71) Applicant: Hitachi Energy Switzerland AG, Baden (CH)

(72) Inventors: Zoltan Repasi, Västerås (SE); Fredrik Graas, Borlänge (SE); Erik Forsberg, Smedjebacken (SE); Peter Astrand, Bälinge (SE); Ronnie Blomberg, Ludvika (SE); Alejandra Ravanal, Uppsala (SE)

(73) Assignee: HITACHI ENERGY SWITZERLAND AG, Baden (CH)

( * ) Notice: Subject to any disclaimer, the term of this patent is extended or adjusted under 35 U.S.C. 154(b) by 0 days.

(21) Appl. No.: 18/015,356

(22) PCT Filed: Jun. 24, 2021

(86) PCT No.: PCT/EP2021/067309
§ 371 (c)(1),
(2) Date: Jan. 10, 2023

(87) PCT Pub. No.: WO2022/017717
PCT Pub. Date: Jan. 27, 2022

(65) Prior Publication Data

US 2023/0197326 A1 Jun. 22, 2023

(30) Foreign Application Priority Data

Jul. 20, 2020 (EP) ..... 20186630

(51) Int. Cl.
*H01F 27/04* (2006.01)
*H01F 41/00* (2006.01)
(Continued)

(52) U.S. Cl.
CPC ..... *H01F 27/04* (2013.01); *H01B 17/265* (2013.01); *H01F 27/40* (2013.01); *H01F 41/005* (2013.01)

(58) Field of Classification Search
CPC ..... H01F 27/04; H01F 27/40; H01F 27/402; H01F 2027/404; H01F 27/32;
(Continued)

(56) References Cited

U.S. PATENT DOCUMENTS 3,073,891 A * 1/1963 Barengoltz ..... H01F 27/04 439/534
3,258,524 A * 6/1966 Walling ..... H01B 17/265 174/18
(Continued)

FOREIGN PATENT DOCUMENTS

EP 2528071 A1 11/2012
JP 2008027003 A 2/2008
(Continued)

OTHER PUBLICATIONS

Decision for Grant of Patent for Korean Patent Application No. 10-2023-7001460, dated Feb. 1, 2023, 4 pages.
(Continued)

*Primary Examiner* — Tszfung J Chan
(74) *Attorney, Agent, or Firm* — Sage Patent Group

(57) ABSTRACT

An electrical induction device includes a housing and a contact arrangement in the housing of the electrical induction device for electrically contacting an electrical conductor. The contact arrangement includes a conductor tube, a receiver contact which is fastened to the conductor tube and configured to receive and electrically connect with the electrical conductor, and a resilient suspension arrangement fastened to the housing and connected to an outside of the conductor tube such that the receiver contact is resiliently
(Continued)

movable in a plane which is parallel to a cross section of the conductor tube while being substantially immovable in an axial direction of the conductor tube.

12 Claims, 2 Drawing Sheets

(51) Int. Cl.
*H01B 17/26* (2006.01)
*H01F 27/40* (2006.01)

(58) Field of Classification Search
CPC ..... H01F 27/321; H01F 27/322; H01F 27/08; H01F 27/10; H01F 27/105; H01F 27/12; H01F 27/125; H01F 27/14; H01F 27/16; H01F 27/18; H01F 27/085; H01F 27/20; H01B 17/265
USPC ..... 336/90, 92, 94
See application file for complete search history.

(56) References Cited

U.S. PATENT DOCUMENTS

| | | | | |
|---|---|---|---|---|
| 5,952,617 | A * | 9/1999 | Bergstrom | H01F 27/04 336/107 |
| 2013/0033349 | A1* | 2/2013 | Takano | H01F 27/04 29/602.1 |
| 2021/0035713 | A1* | 2/2021 | Engels | H01F 27/04 |

FOREIGN PATENT DOCUMENTS

| | | | |
|---|---|---|---|
| KR | 200283790 | Y1 | 7/2002 |
| KR | 101673523 | B1 | 11/2016 |
| WO | 2008027003 | A1 | 3/2008 |

OTHER PUBLICATIONS

International Search Report and Written Opinion of the International Searching Authority, PCT/EP2021/067309, dated Aug. 12, 2021, 16 pages.

* cited by examiner

ELECTRICAL INDUCTION DEVICE WITH CONTACT ARRANGEMENT FOR ELECTRICALLY CONTACTING AN ELECTRICAL CONDUCTOR

CROSS REFERENCE TO RELATED APPLICATIONS

This application is a 35 U.S.C. § 371 national stage application of PCT International Application No. PCT/EP2021/067309 filed on Jun. 24, 2021, which in turn claims priority to European Application No. 20186630.8 filed on Jul. 20, 2020, the disclosures and content of which are incorporated by reference herein in their entireties.

TECHNICAL FIELD

The present disclosure relates to a contact arrangement in a housing of an electrical induction device for electrically contacting an electrical conductor.

BACKGROUND

When electrically connecting a bushing with a transformer, typically a manhole in the transformer tank is needed for accessing and manually connecting an electrical contact at the proximal end of the busing within the transformer. Alternatively, a draw-rod system may be used for connecting an electrical contact at the distal end of the bushing, without the need for a manhole.

SUMMARY

It is an objective of the present disclosure to provide a way of connecting an electrical conductor, e.g. of a bushing, cable ending or surge arrester, with an electrical induction device, e.g. a transformer or a reactor, in a contact arrangement within a housing of the induction device without the need for a manhole in the housing for manually accessing the contact arrangement. The contact arrangement may be regarded as comprising a plug-in contact which may be connected automatically, without the need for an operator physically accessing and adjusting the contact arrangement.

According to an aspect of the present disclosure, there is provided an electrical induction device comprising a housing and a contact arrangement in the housing of the electrical induction device for electrically contacting an electrical conductor. The contact arrangement comprises a conductor tube, a receiver contact which is fastened to the conductor tube and configured to receive and electrically connect with the electrical conductor, and a resilient suspension arrangement fastened to the housing and connected to an outside of the conductor tube such that the receiver contact is resiliently movable in a plane which is parallel to a cross section of the conductor tube while being substantially immovable in an axial direction of the conductor tube.

According to another aspect of the present disclosure, there is provided an induction device arrangement comprising an embodiment of the electrical induction device of the present disclosure, and the electrical conductor, wherein the contact arrangement is electrically contacting the electrical conductor.

According to another aspect of the present disclosure, there is provided an electrical connection comprising an electrical conductor and an embodiment of the contact arrangement of the present disclosure electrically contacting the electrical conductor.

By means of the resilient suspension arrangement, the receiver contact is movable in the xy-plane such as to allow it to automatically adjust to the position of the electrical conductor as it is introduced in the contact arrangement. The increased tolerances thus provided for the position and/or inclination of the electrical conductor as it is introduced into the contact arrangement facilitates electrically (galvanically) connecting the electrical conductor with the conductor tube via the receiver contact of the contact arrangement without having to manually adjust the contact arrangement, e.g. via a manhole in the housing. The electrical conductor may more easily be connected by only manipulating it from the outside, not the inside, of the housing.

It is to be noted that any feature of any of the aspects may be applied to any other aspect, wherever appropriate. Likewise, any advantage of any of the aspects may apply to any of the other aspects. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

Embodiments will be described, by way of example, with reference to the accompanying drawings, in which.

DETAILED DESCRIPTION

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

Figure 1:
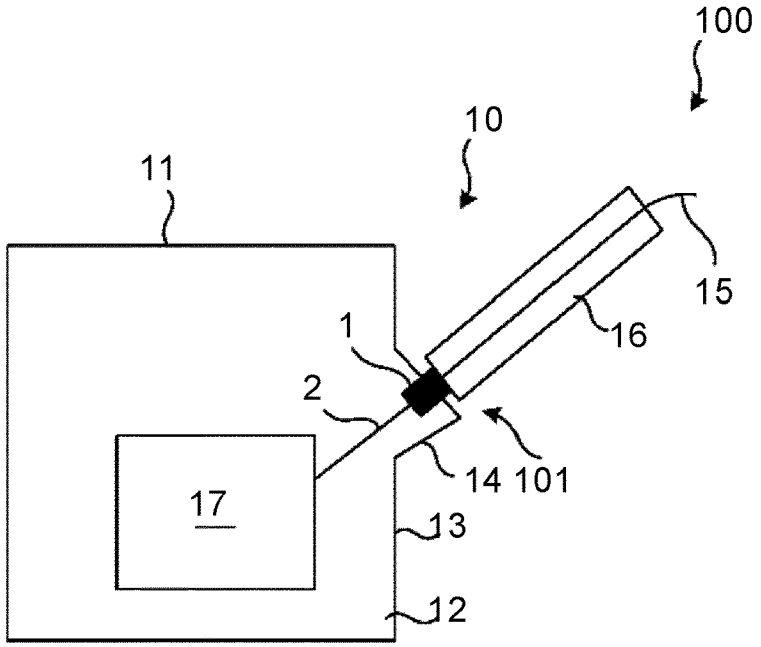
FIG. 1 is a schematic sectional side view of an induction device arrangement comprising an electrical induction device and an electrical conductor connected thereto, in accordance with some embodiments of the present disclosure.

FIG. 1 illustrates an induction device arrangement 100 comprising an electrical induction device 10 and a conductor arrangement 16.

The induction device 10 may e.g. be or comprise a transformer or a reactor, e.g. a high-voltage transformer. The induction device 10 comprises a housing 11, e.g. a transformer tank or reactor tank, which may enclose conductor windings of a winding arrangement 17 of the induction device. The induction device 10 may be fluid-filled, the housing 11 being filled with an electrically insulating fluid 12, e.g. a gas or liquid, typically a liquid such as a transformer oil or ester liquid. Through an opening in a top or side wall 13 of the housing 11, an electrical conductor 15 may be galvanically connected to the induction device 10, typically to any of the windings of the winding arrangement 17, e.g. at a turret 14 of said wall 13.

The conductor arrangement 16 comprises the electrical conductor 15 and may e.g. be or comprise a bushing, a cable ending or a surge arrester, e.g. a high-voltage bushing. Preferably, the conductor arrangement is sealed, e.g. by means of the contact arrangement 1, such that the electrically insulating fluid 12 (if any) is not able to enter the conductor arrangement 16, e.g. in or along the electrical conductor 15. The electrical conductor may be in the form of e.g. a solid rod, a flexible wire or a tube, preferably a conductor tube.

The contact arrangement 1 is arranged within the housing 11, typically fastened to or otherwise mounted to the housing. The conductor arrangement 1 is arranged for electrically (galvanically) connecting the electrical conductor 15 with the conductor tube 2 of the induction device 10 within the housing 11, to form an electrical connection 101.

Figure 2:
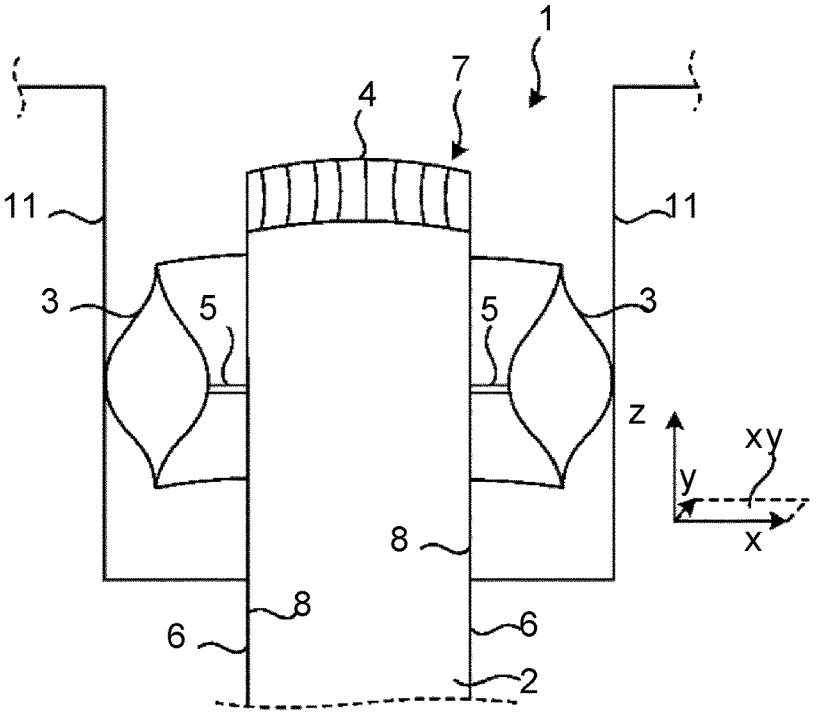
FIG. 2 is a schematic view in longitudinal section of a contact arrangement arranged in a housing of an electrical induction device, in accordance with some embodiments of the present disclosure.

FIG. 2 illustrates a contact arrangement 1 mounted to the housing 11, e.g. in a turret 14 thereof. The housing 11 may e.g. form a tubular opening through a wall 13 of the housing in which opening the contact arrangement is mounted.

The contact arrangement 1 comprises a receiver contact 4, e.g. comprising flexible fingers or springs, or the like, for pressing against the electrical conductor 15 when it is received in the receiver contact, forming a galvanic connection with the electrical conductor. The receiver contact 4 is fastened to the conductor tube 2, e.g. to an end 7 of the conductor tube or on an inside 8 of the conductor tube at said end 7. As an example, the receiver contact 4 may be or comprise a MULTILAM flexo ML-CUX™ from Stäubli.

In accordance with the present disclosure, the receiver contact 4 is movable in an xy-plane (a plane which is parallel to a cross section of the conductor tube 2, e.g. a radial plane of the conductor tube 2) while being substantially immovable in the z-direction which is the axial (longitudinal) direction of the conductor tube 2 (see also the schematic three dimensional cartesian coordinate system illustrated on the right side in FIG. 2, illustrating x, y and z directions as well as an xy-plane). By the receiver contact 4 being movable in the xy-plane, the receiver contact is able to adjust its position in the xy-plane, without e.g. being pressed further into the housing 11 in the z-direction, to receive and connect with a proximal end 18 of the electrical conductor 15 as it is being inserted into the opening in the wall 13. To further aid in the adjustment of the receiver contact 4 position when receiving the electrical conductor, the receiver contact 4 and/or the end 7 of the conductor tube 2 may comprise a guiding surface, e.g. comprising chamfers or the like for guiding the proximal end 18 of the electrical conductor 15 into the receiver contact while exerting pressure to induce the movement of the receiver contact in the xy-plane. A corresponding guiding surface may be present on an outside of the proximal end 18 (FIG. 3) of the electrical conductor, e.g. by the proximal end 18 being tapered or rounded. Since the receiver contact 4 fastened to the conductor tube 2, it is implied that also said conductor tube 2 is movable in the xy-plane, at least at the end 7 of the conductor tube while other parts of the conductor tube may be fixed. It is noted that the conductor tube 2 may comprise a flexible portion to allow an end portion of the conductor tube, at the end 7 thereof, to be movable in the xy-plane, while another portion of the conductor tube is immovable (fixed).

The receiver contact 4 is movable by means of a resilient suspension arrangement 3 fastened to the housing 11 and connected to an outside 6 of the conductor tube 2 such that the receiver contact 4 is resiliently movable in the xy-plane. The resilient suspension arrangement 3 may comprise at least one spring which has spring action in an xy-plane but immovable in the z-direction. The spring may e.g. be formed by bent sheets of e.g. spring steel or the like. However, it may be preferable that the resilient suspension arrangement 3 is not conductive, insulating the conductor tube 2 from the housing 11. The resilient suspension arrangement 3 is typically arranged outside of and around the conductor tube 2, e.g. in a radial plane of the conductor tube such as along a circumference of the conductor tube. The resilient suspension arrangement 3 may be intermittently or continuously connected to the outside 6 of the conductor tube 2 along the circumference of the conductor tube. In some embodiments, the resilient suspension arrangement 3 may be connected to the outside of the conductor tube 2 via a spacer 5, e.g. a ring encircling the outside 6 of the conductor tube in a radial plane (xy-plane) of the conductor tube.

By the resilient suspension arrangement 3 preventing the receiver contact 4 from moving in the axial (z) direction, the receiver contact 4 is typically also prevented from rotating about the x or y axis, i.e. the resilient suspension arrangement 3 takes up torque about the x and y axes. Also, the receiver contact 4, as well as the conductor tube 2, is typically by the resilient suspension arrangement 3 prevented from rotating about the axial (z) axis.

Figure 3:
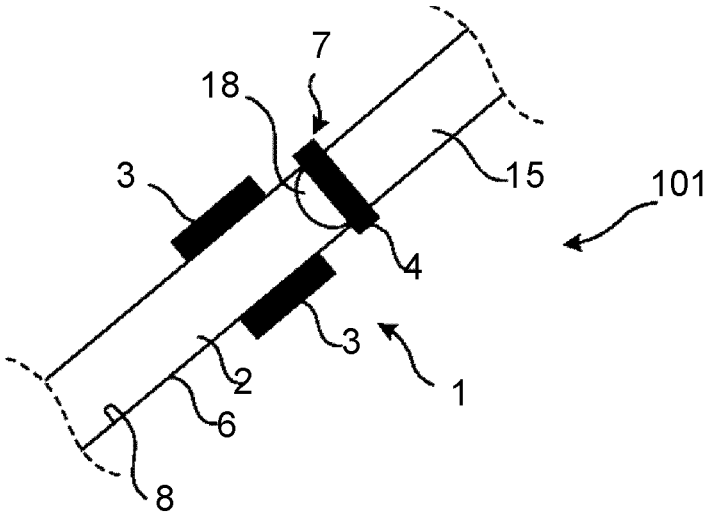
FIG. 3 is a schematic view in longitudinal section of an electrical connection comprising an electrical conductor and a contact arrangement electrically contacting the electrical conductor, in accordance with some embodiments of the present disclosure.

FIG. 3 illustrates an electrical connection 101 formed by the electrical conductor 15 having been received by the receiver contact 4 and electrically connected to the conductor tube 2 via said receiver contact. As mentioned above, a guiding surface may be present on an outside of the proximal end 18 of the electrical conductor 15, e.g. by the proximal end 18 being tapered or rounded or otherwise exhibiting chamfers, which may exert pressure on the receiver contact 4 and/or the end 7 of the conductor tube 2 to induce the movement of the receiver contact in the xy-plane as the proximal end 18 of the electrical conductor 15 is received by the receiver contact 4.

When the contact arrangement 1 is not contacting the electrical conductor 15, the receiver contact 4 may be in a resting position (an unbiased position), while when the receiver contact is receiving the proximal end 18 of the electrical conductor 15, the receiver contact 4 may be moved in the xy-plane to a biased position to accommodate and properly connect to the electrical conductor. In some embodiments, the receiver contact 4 may thus be resiliently movable a maximum distance from the resting position in the xy-plane to said biased position, wherein said maximum distance may be e.g. within a range of from 10 mm to 30 mm or 50 mm. The maximum distance typically depends on the design of the resilient suspension arrangement 3.

The present disclosure has mainly been described above with reference to a few embodiments. However, as is readily appreciated by a person skilled in the art, other embodiments than the ones disclosed above are equally possible within the scope of the present disclosure, as defined by the appended claims.

The invention claimed is:

1. An electrical induction device comprising:

a housing; and a contact arrangement in the housing of the electrical induction device for electrically contacting an electrical conductor, the contact arrangement comprising:

a conductor tube;

a receiver contact which is fastened to the conductor tube and configured to receive and electrically connect with the electrical conductor; and a resilient suspension arrangement fastened to the housing and connected to an outside of the conductor tube such that the receiver contact is resiliently movable in a plane which is parallel to a cross section of the conductor tube while being substantially immovable in an axial direction of the conductor tube.

2. The electrical induction device of claim 1, wherein the receiver contact is annular and fastened to an inside or an end of the conductor tube.

3. The electrical induction device of claim 1, wherein the resilient suspension arrangement is intermittently or continuously connected to the outside of the conductor tube around a circumference of the conductor tube.

4. The electrical induction device of claim 3, wherein the resilient suspension arrangement is connected to the outside of the conductor tube via a ring encircling the outside of the conductor tube in a radial plane of the conductor tube.

5. The electrical induction device of claim 1, wherein the receiver contact is resiliently movable a maximum distance from a resting position in the parallel plane which is within a range of from 10 mm to 30 mm.

6. The electrical induction device of claim 1, wherein the housing is filled with an electrically insulating fluid.

7. The electrical induction device of claim 6, wherein the electrically insulated fluid is a liquid.

8. The electrical induction device of claim 1, wherein the electrical induction device is or comprises a transformer or a reactor.

9. An induction device arrangement comprising:

the electrical induction device of claim 1; and the electrical conductor;

wherein the contact arrangement is electrically contacting the electrical conductor.

10. The induction device arrangement of claim 9, further comprising any one of: a bushing, a cable ending or a surge arrester, in which the electrical conductor is comprised.

11. An electrical connection comprising:

the electrical conductor; and the contact arrangement of claim 1 electrically contacting the electrical conductor.

12. The electrical connection of claim 11, wherein a proximal end of the electrical conductor is tapered or rounded.

* * * * *